US005743751A

United States Patent [19]

Davis et al.

[11] Patent Number: 5,743,751

[45] Date of Patent: Apr. 28, 1998

[54] STRADDLE ADAPTER FOR MOUNTING EDGE CONNECTORS TO A PRINTED CIRCUIT BOARD

[76] Inventors: Philip E. Davis, P.O. Box 580, Delray Beach, Fla. 33444; John C. Beck, 1502 N.E. 12 St., Fort Lauderdale, Fla. 33304; John M. Pierini, 2301 N.W. 93 La., Sunrise, Fla. 33322; Andrea L. Garza, 7630 Ladson Ter., Lakeworth, Fla. 33467

[21] Appl. No.: 645,763

[22] Filed: May 14, 1996

[51] Int. Cl.[6] ..... H01R 9/09

[52] U.S. Cl. ..... 439/79

[58] Field of Search ..... 439/79, 80

[56] References Cited

U.S. PATENT DOCUMENTS

| | | | |
|---|---|---|---|
| 3,444,506 | 5/1969 | Wedekind | 439/405 |
| 3,848,221 | 11/1974 | Lee, Jr. | 439/268 |
| 4,274,700 | 6/1981 | Keglewitsch et al. | 439/682 |
| 4,487,463 | 12/1984 | Tillotson | 439/68 |
| 4,572,604 | 2/1986 | Ammon et al. | 439/633 |
| 4,655,526 | 4/1987 | Shaffer | 439/268 |
| 4,734,042 | 3/1988 | Martens et sl. | 439/62 |
| 4,909,743 | 3/1990 | Johnson et al | 439/60 |
| 4,959,750 | 9/1990 | Cnyrim et al. | 361/401 |
| 4,975,066 | 12/1990 | Sucheski et al. | 439/63 |
| 5,037,311 | 8/1991 | Frankeny et al. | 439/66 |
| 5,071,363 | 12/1991 | Reylek et al. | 439/291 |
| 5,088,009 | 2/1992 | Harada et al. | 361/413 |
| 5,090,911 | 2/1992 | Welsh | 439/79 |
| 5,160,275 | 11/1992 | Nakamura et al. | 439/328 |
| 5,261,828 | 11/1993 | Kandybowski | 439/79 |
| 5,326,936 | 7/1994 | Taniuchi et al. | 174/260 |
| 5,330,372 | 7/1994 | Pope et al. | 439/692 |
| 5,351,393 | 10/1994 | Gregoire | 29/835 |
| 5,397,241 | 3/1995 | Cox et al. | 439/79 |

FOREIGN PATENT DOCUMENTS

| | | |
|---|---|---|
| 3737819 A1 | 5/1988 | Germany . |
| WO 94/13034 | 6/1994 | WIPO . |
| WO 94/27345 | 11/1994 | WIPO . |

OTHER PUBLICATIONS

AMP Product Guide, Printed Circuited Board Connectors 3, pp. 3008, 3067–3068, 3102–3103, 3122–3123.

AMP Product Information Bulletin, "AMP–ASC Interconnection Systems," pp. 1–4 (1991).

AMP Product Guide, "Micro–Strip Interconnection System," pp. 3413–3414 (June, 1991).

Du Pont Connector Systems Product Catalog A, "Rib–Cage II Through–Mount Shrouded Headers" and Micropax Board–to–Board Interconnect System, pp. 2–6, 3–0, 3–1 (Feb., 1992).

*Primary Examiner*—Neil Abrams
*Assistant Examiner*—Barry M.L. Standig

[57] ABSTRACT

A straddle adapter includes first and second plates and a side end. The side end joins the first and second plates at an edge such that the first and second plates are spaced apart and substantially parallel to each other. An edge of a printed circuit board is received between inner surfaces of the first and second plates. The outer surfaces of the first and second plates include snap connectors or other structure for mounting separate first and second edge connectors thereto. The adapter maintains the edge connectors at a predetermined separation distance. The inner surfaces of the first and second plate include deformable rails that deform as the edge of the circuit board is inserted between the first and second plates. The deformable rails compensate for variations in thickness of the circuit board and secure the adapter to the circuit board.

8 Claims, 8 Drawing Sheets

STRADDLE ADAPTER FOR MOUNTING EDGE CONNECTORS TO A PRINTED CIRCUIT BOARD

BACKGROUND OF THE INVENTION

This application is related in subject matter to U.S. application Ser. No. 08/645,764 [Attorney Docket No. 40879-5071], entitled "Electrical Connector Assembly", filed concurrently herewith.

1. Field of the Invention

The present invention relates to a straddle adapter for mounting an apparatus on a printed circuit board, and more particularly to a straddle adapter for mounting edge connectors on opposing sides of a printed circuit board to form a double-sided edge connector.

2. Description of the Prior Art

In many applications, an edge connector is mounted to an edge of a printed circuit board to establish an electrical connection between the components mounted on the circuit board and components external to the circuit board. Printed circuit boards in computers, for example, include edge connectors for forming a connection between the mother board and various peripheral devices. The edge connector on the mother board plugs into a corresponding connector coupled to equipment off the mother board, thereby permitting electrical signals to be transmitted between the mother board and the equipment external to the mother board.

In some applications, an edge connector has contacts that surface mount to the circuit board. These contacts have a predetermined length that permits them to contact a circuit board of a given thickness. However, if the circuit board is thinner than expected, the connector housing must be tilted away from the circuit board to permit the contacts to touch the circuit board. If the circuit board is thicker than expected, the connector housing must be tilted toward the circuit board to permit contact. In either or both cases, the edge connector becomes misaligned with its corresponding connector.

As electrical equipment becomes more powerful, printed circuit boards require an increasing number of connections. One way to increase the number of connectors is to mount edge connectors on opposing sides of the printed circuit board. This arrangement is sometimes referred to as a double-sided edge connector. However, the thickness of a given circuit board varies over a tolerance range. When edge connectors are mounted to opposing sides of the circuit board, the separation between the opposing edge connectors varies with the thickness of the circuit board. The corresponding connectors off the circuit board are separated by a predetermined distance. Because the distance between the edge connectors varies, but the distance between the corresponding connectors off the circuit board is constant, a mismatch may therefore occur when an attempt is made to plug the edge connectors on the circuit board into the corresponding connectors off the circuit board. The mismatch may result in damage to the connectors, short circuits, open circuits, and/or other adverse consequences.

It is not desirable to require technicians to adjust the separation of the connectors off the circuit board to match the separation of the edge connectors mounted to the circuit board. Accordingly, there exists a need in the art for preventing mismatch of double-sided edge connectors to corresponding connectors off the circuit board without requiring adjustment by technicians. Moreover, there is a need to prevent misalignment of connectors on a circuit board with connectors off the circuit resulting from variations in the thickness of the circuit board.

U.S. Pat. No. 5,160,275 to Nakamura et al. discloses a frame for preventing the contacts of a single connector housing from scraping the traces and solder on a circuit board when the connector housing is attached to the circuit board. Two parallel rows of resilient contacts extend from the front of the connector housing. A separate frame is provided for spreading the two rows of contacts apart a distance greater than the thickness of the circuit board. The edge of the circuit board is then pressed into the frame a sufficient distance to move the frame further into the connector housing so that the contacts are no longer separated by the frame. At this point, the contacts press against the circuit board.

The edge connectors of the type disclosed in Nakamura et al. have poor performance characteristics attributable to inherent capacitance and electromagnetic interference, and are costly to manufacture because the contacts are plated with gold or other expensive materials in an attempt to improve performance. More significantly, the connectors of this type have a relatively low contact density, which for design reasons cannot be increased to meet the current industry demand for more contacts. High-density connectors have highly complex pin arrangements, including multiple tiers of connectors for connection to each side of the circuit board. Such high-density connectors require precision placement of a large number of closely-spaced pins during manufacture.

Placement of a large number of pins within a single housing is extremely time consuming and technically difficult. One problem is that pins that are already inserted into the connector housing impede the insertion of additional pins. Pins are too often bent or broken during insertion. Moreover, the difficulty increases dramatically for large arrays of pins and for complex arrangements of pins. Thus, there is a further need in the art to simplify the manufacture of high density connectors.

SUMMARY OF THE INVENTION

The present invention has been made in view of the above circumstances and has as an object to provide an adapter for mounting separate edge connectors on opposing sides of a printed circuit board so that the edge connectors are level and separated by a predetermined distance, despite variations in thickness of the printed circuit boards.

A further object of the present invention is to provide a small, lightweight, and easily manufacturable straddle adapter for mounting apparatus, such as edge connectors, on opposite sides of a printed circuit board.

A further object of the invention is to provide a straddle adapter detached from edge connectors and that may be separately coupled to a printed circuit board.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises an adapter for coupling a first edge connector and a second edge connector independent of the first edge connector to opposite sides of a circuit board. The adapter includes first and second plates and a side end that joins an edge of said first and second plates so that the first and second plates are spaced apart and substantially parallel to each other. The first and second plates have inner surfaces facing each other and outer surfaces facing away from each other, and the inner surfaces of the first and second plates are adapted to receive an edge of the circuit board therebetween. The adapter further includes first means for mounting the first edge connector to the outer surface of the first plate and second means for mounting the second edge connector to the outer surface of the second plate.

The first and second plates of the adapter may each include a central region and end regions on opposite ends of the central region. A slit may be located between the central region and each end region of the first and second plates such that opposing end regions of the first and second plates may be drawn together and the central regions may be maintained substantially parallel to each other. The end regions may include a deformable rail on their inner surfaces. The deformable rail is adapted to receive opposing sides of the circuit board. The deformable rail may comprise a swellout on the inner surface of the end regions.

The first means for mounting may include first and second snap connectors secured to opposite end regions of the first plate, and the second means for mounting may include third and fourth snap connectors secured to opposite end regions of the second plate. The snap connectors may each include a boss for positioning the first and second edge connectors at a predetermined position.

A hole may be formed through each of the end regions of the first and second plates. The holes in opposing end regions may receive a fastener for attaching the adapter to the circuit board. The adapter may also include at least one side support on each of the first and second plates. The side supports support the back ends of the first and second edge connectors, respectively, when the first and second edge connectors are connected together with corresponding connectors to form an electrical connection.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate embodiment(s) of the invention and together with the description, serve to explain the principles of the invention.

DESCRIPTION OF THE PREFERRED EMBODIMENT

Reference will now be made in detail to the present exemplary embodiment(s) of the invention illustrated in the accompanying drawings. Wherever possible, the same reference numbers will be used throughout the drawings to refer to the same or like parts.

FIGS. 1–5 illustrate various views of the straddle adapter of the present invention. As shown in FIGS. 1–4, the straddle adapter 10 includes first and second plates 100 and 200, and a side end 300 coupled to the edges of the first and second plates 100, 200 such that the first and second plates 100, 200 are spaced apart and substantially parallel to each other. In the Figures, the side end 300 is coupled to the edges of the first and second plates 100, 200 in their entirety. Of course, the side end 300 may couple only a portion or portions of the edges of the first and second plates 100, 200 consistent with the present invention. The side end 300 provides depth control by limiting the distance that the circuit board 40 can be inserted into the straddle adapter 10.

In one preferred embodiment, the straddle adapter 10 is molded of a single piece of a heat resistant, insulative material, for example, a thermoplastic or thermoset resin such as VECTRA E-130, available from Hoechst Celanese Corporation. An edge of a circuit board is received between the first and second parallel plates 100, 200, as discussed in greater detail below.

Figure 1:
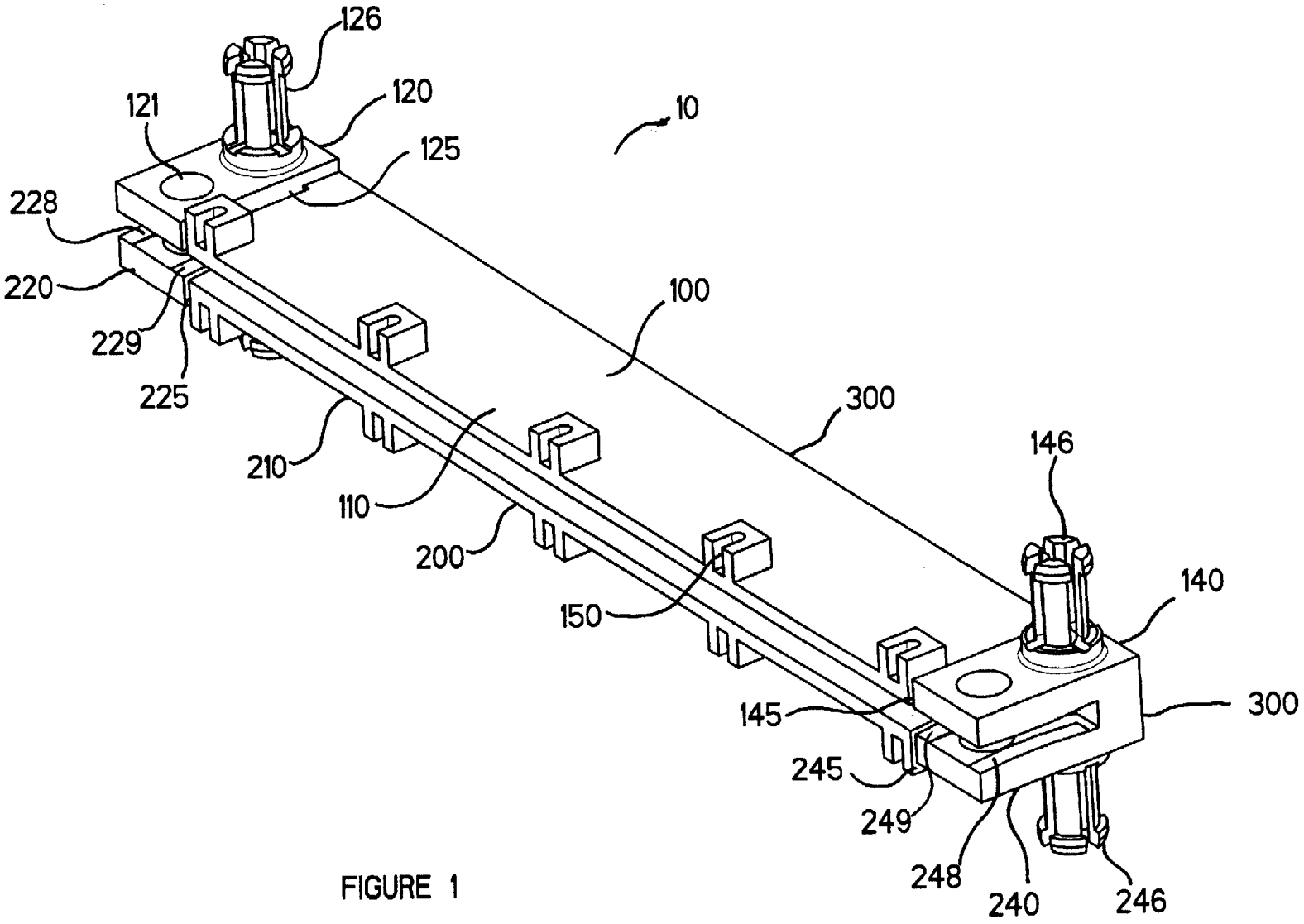
FIG. 1 is an isometric view of the straddle adapter according to the present invention.
Figure 2:
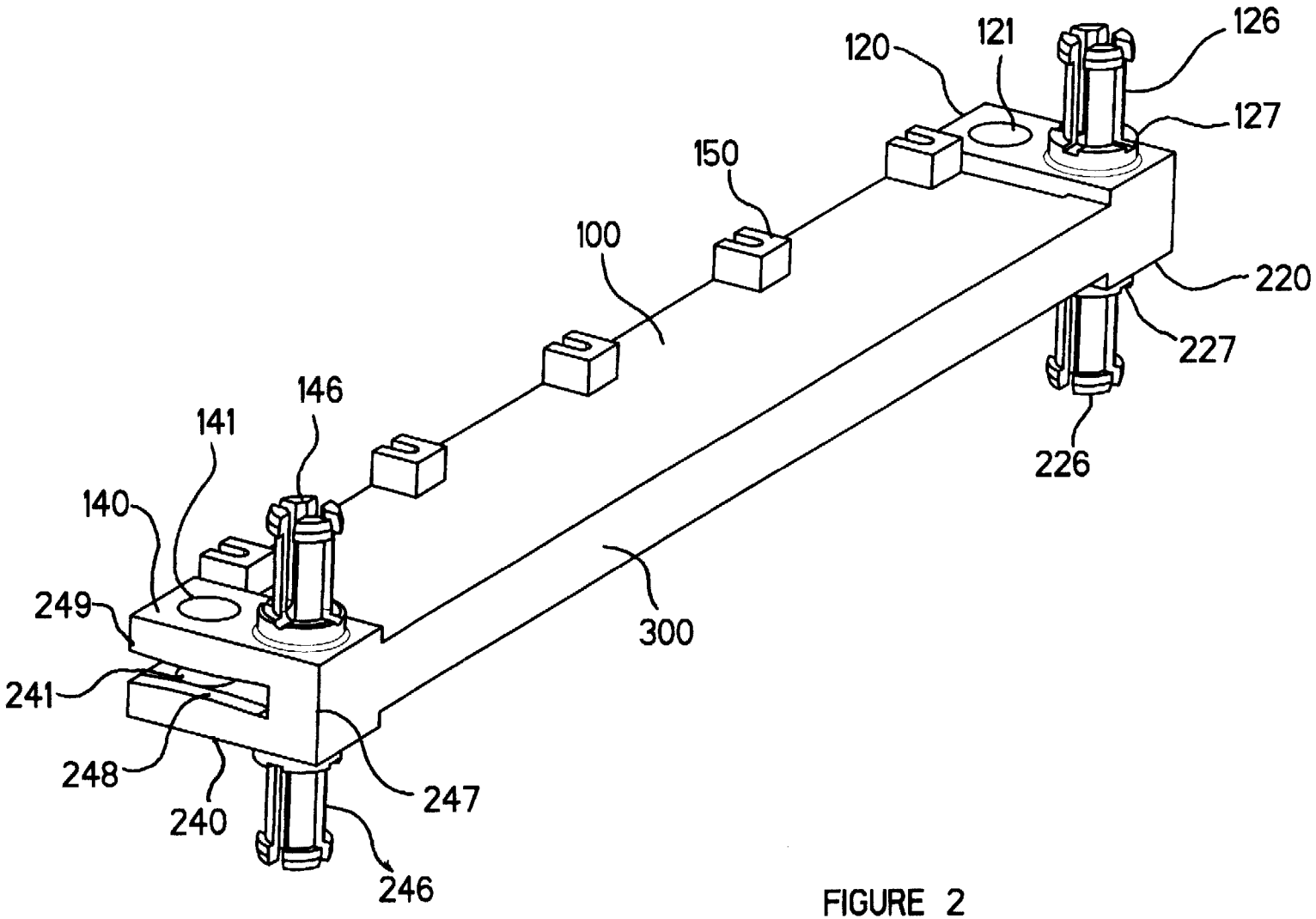
FIG. 2 is a further isometric view of the straddle adapter of FIG. 1 from a different perspective.
Figure 3:
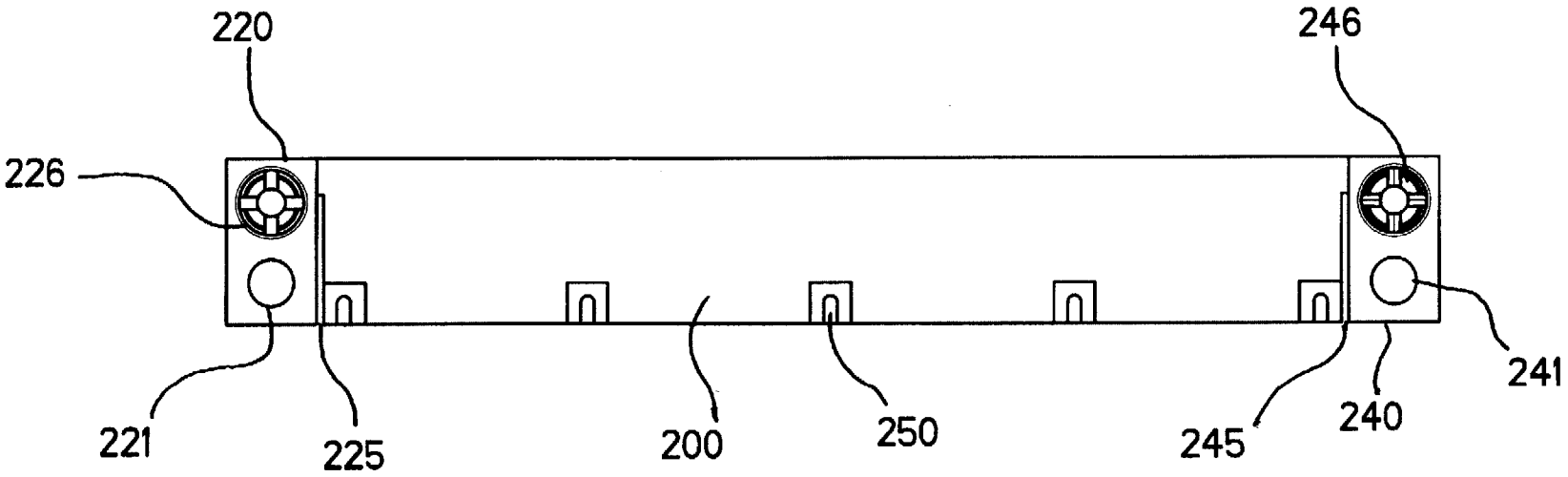
FIG. 3 is a bottom view of the straddle adapter of FIG. 1.
Figure 4:
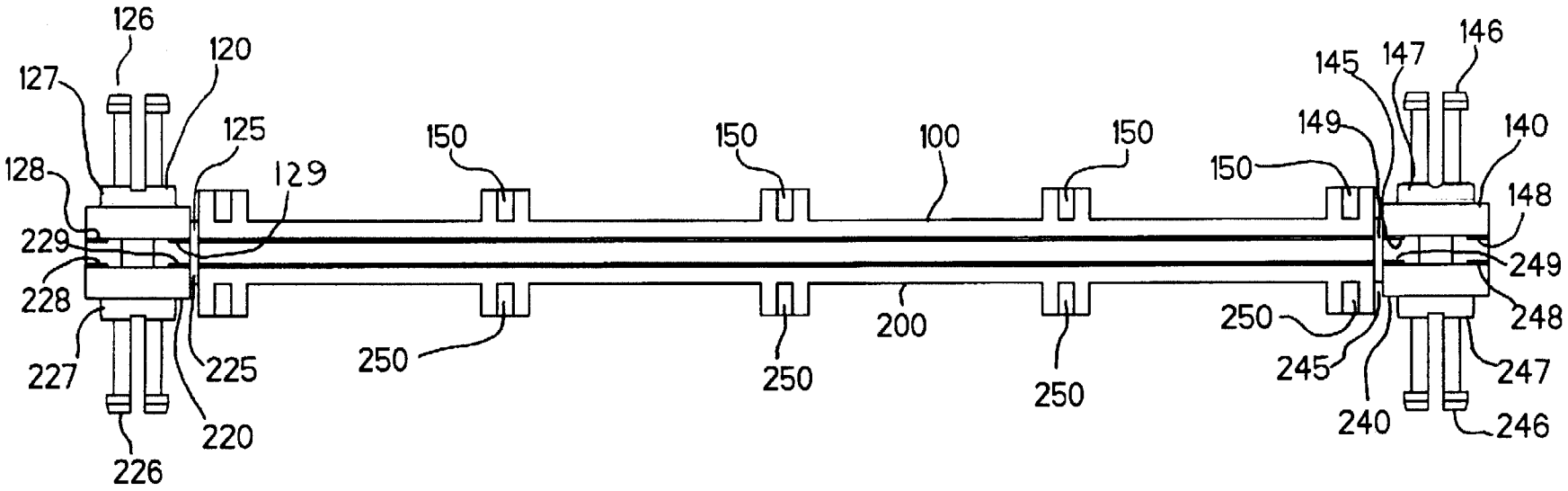
FIG. 4 is a back view of the straddle adapter of FIG. 1.

Each of the plates 100, 200 includes a central region 110, 210 and first and second end regions 120, 140; 220, 240 on opposite ends of the respective central regions 110, 210. As shown in FIGS. 1 and 2, the end regions 120, 140, 220, 240 may be thicker than the central regions 110, 210 to provide a sturdy connection to the circuit board. In one embodiment, support edges 150, 250 may be provided as a stop to prevent a shear force on the contacts and solder joints. The support edges 150, 250 project from the outer surfaces of the central regions 110, 210. When an edge connector is mounted on the straddle adapter 10, the support edges abut against the side of the edge connector to precisely position the edge connector and to prevent the edge connector from bowing at its center as a result of pressure applied during connection.

A slit 125, 145, 225, 245 may be provided between each end region 120, 140; 220, 240 and its adjoining central region 110, 210. The slits 125, 145, 225, 245 enable opposing end portions 120, 220; 140, 240 to be drawn together, for example, to secure the straddle adapter 10 to the printed circuit board, without also bending together the central regions 110, 210. As a result, the forces coupling the straddle adapter 10 to the circuit board are born almost entirely by the end regions 120, 140, 220, 240 and the central regions 110, 210 are maintained parallel to each other. The contacts of the edge connectors are therefore maintained parallel to each other to facilitate connection.

Figure 6:
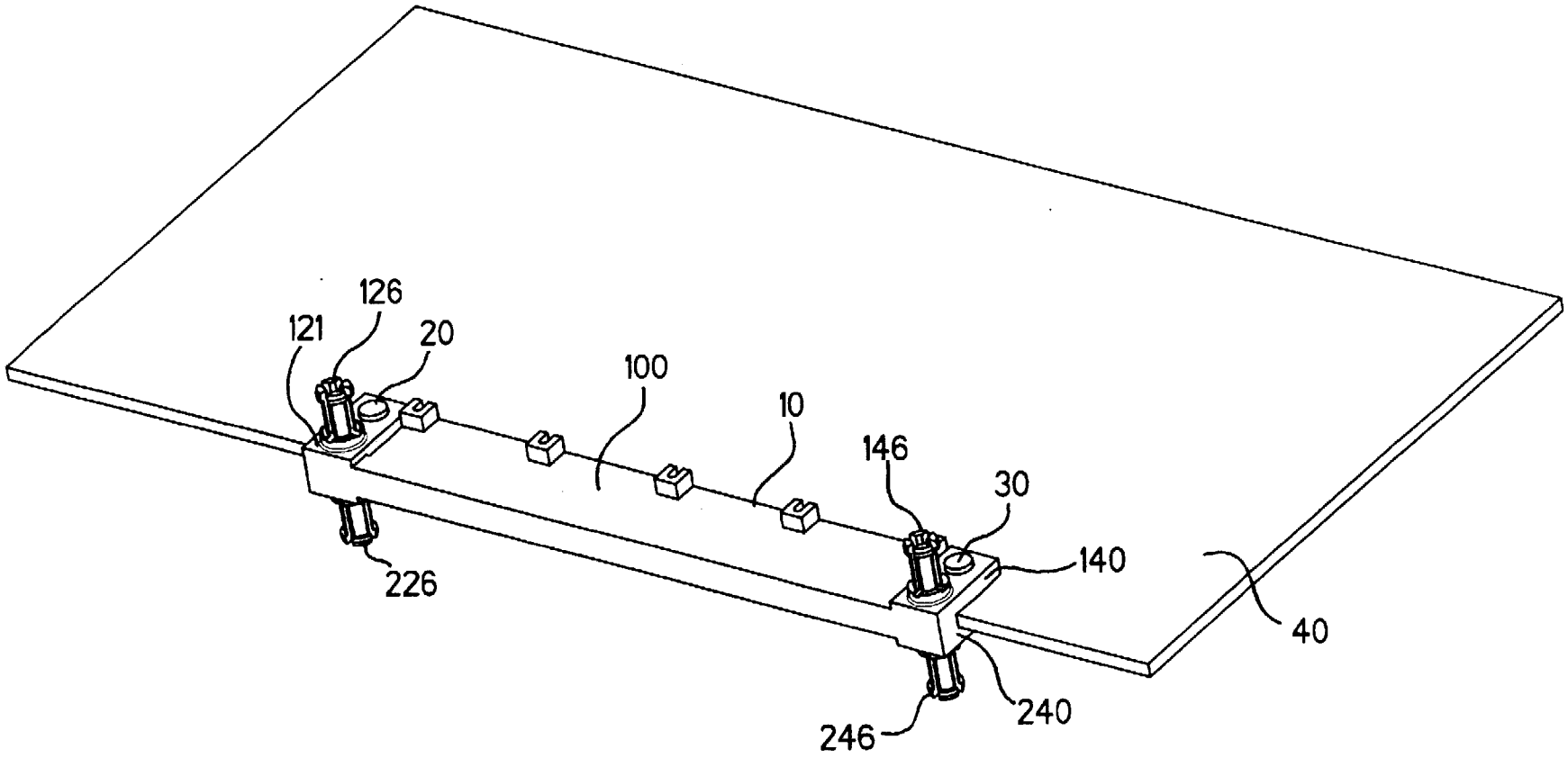
FIG. 6 is an isometric view of a straddle adapter mounted on a printed circuit board.

Coaxial holes 121, 221; 141, 241 may be provided in opposing end regions 120, 220; 140, 240. As shown in FIG. 6, a rivet or other fastener 20, 30 may be inserted through each pair of the holes 121, 221; 141, 241 to clamp the straddle adapter 10 to the circuit board 40. The fasteners 20, 30 may be removable from the holes 121, 221; 141, 241 to enable the straddle adapter 10 to be easily detached from the printed circuit board 40. Of course, the end regions 120, 140, 220, 240 may be coupled to the circuit board 40 by other means.

Each end region 120, 140, 220, 240 also may include a snap connector 126, 146; 226, 246 on opposite sides thereof. The snap connectors 126, 226; 146, 246 on the same side of the straddle adapter 10 may be used to couple separate first and second edge connectors or other apparatus to outer surfaces of plates 100, 200 of the straddle adapter 10. Mounting two separate edge connectors on opposite sides of the straddle adapter 10 greatly simplifies the manufacture of high-density edge connectors. The pins of the connectors may be divided between two separate connector bodies. Thus, as pins are inserted into the connector body, there are fewer pins already in place. Accordingly, there are fewer pins to impede the insertion of additional pins, pin placement is easier, and fewer pins are bent or broken.

Moreover, when the straddle adapter is fitted on the circuit board and then the edge connector is mounted to the straddle adapter, solder paste is not wiped off the surface of the circuit board. The use of two separate edge connectors mounted on opposite sides of the straddle adapter thus facilitates manufacture of high-density edge connectors and improves the quality of manufactured connectors by reducing the number of bent and broken pins and improving the electrical connection to the circuit board.

Figure 5:
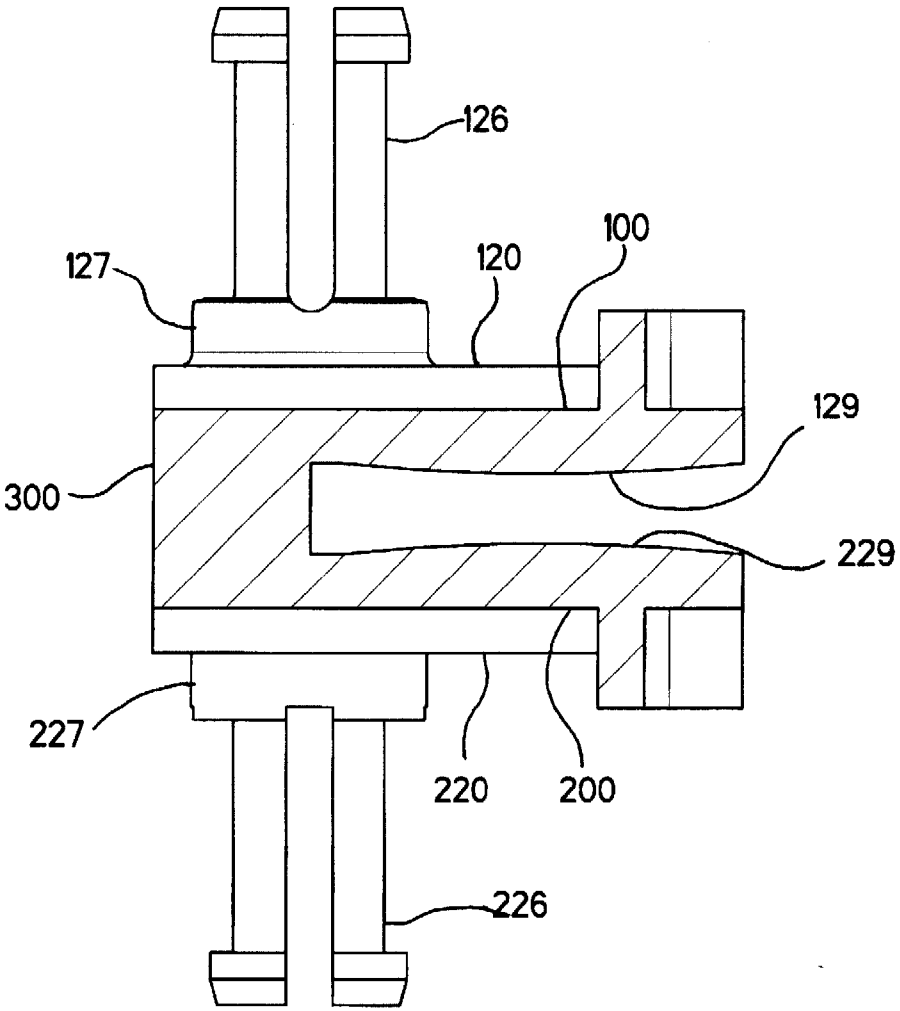
FIG. 5 is a sectional view of a cross section of the straddle adapter of FIG. 1.

As best shown in FIG. 5, each of the snap connectors 126, 146, 226, 246 may include a boss 127, 147, 227, 247 proximal to the surface of its corresponding edge region. The bosses 127, 147, 227, 247 serve to precisely align the edge connectors in three dimensions and to support the edge connectors during insertion. If only a single edge connector is required by the particular application, the snap connectors 126, 146; 226, 246 on one side of the straddle adapter 10 may be removed or omitted.

The use of snap connectors should not be considered to limit the present invention. Edge connectors or other apparatus may be coupled to the straddle adapter by other means, such as adhesive, screws, clips, and other fasteners. For example, each end region 120, 140, 220, 240 may include a threaded hole for receiving a screw, a hole or recess for receiving a snap connector or another type of connector, a post or other protrusion used for connection, clips, or a surface to which glue, epoxy, or other adhesive may be applied, or the edge connectors may be thermally welded to the end regions or staked to the end regions using ultrasonics.

The inner surface of each end region 120, 140, 220, 240 may include first and second deformable tolerance rails 128, 129; 148, 149; 228, 229; 248, 249. As shown in FIG. 5, each rail may be a swellout, e.g., a protuberance, bump, or rib, on the inner surface of each end region. The swellout may include one or more bubbles. As shown in FIG. 5, the swellout may gently slope to a maximum height and then gently slope back. Alternatively, the tolerance rails may be wedge-shaped and arranged to slope toward the side end 300, or resilient structure, such as leaf springs, may be used instead of the tolerance rails. The tolerance rails may deform to the thickness of the circuit board 40, thereby compensating for variations in thickness of the circuit board 40 and increasing the strength of engagement between the straddle adapter 10 and the printed circuit board 40.

The amount of deformation and the force required for deformation to occur may be selected based, at least in part, on the characteristics of the material used to form the rails and the physical design of the rails. Alternatively, the rails may be formed of a relatively hard material that causes the circuit board to deform, or that causes both the rails and the circuit board to deform. Deformation of the rails centers the printed circuit board between the plates of the straddle adapter 10. Consequently, any variation in thickness is spread evenly between the plates of the straddle adapter. As a result, edge connectors coupled to the plates do not have to be tilted to permit their contacts to touch the circuit board.

Figure 7:
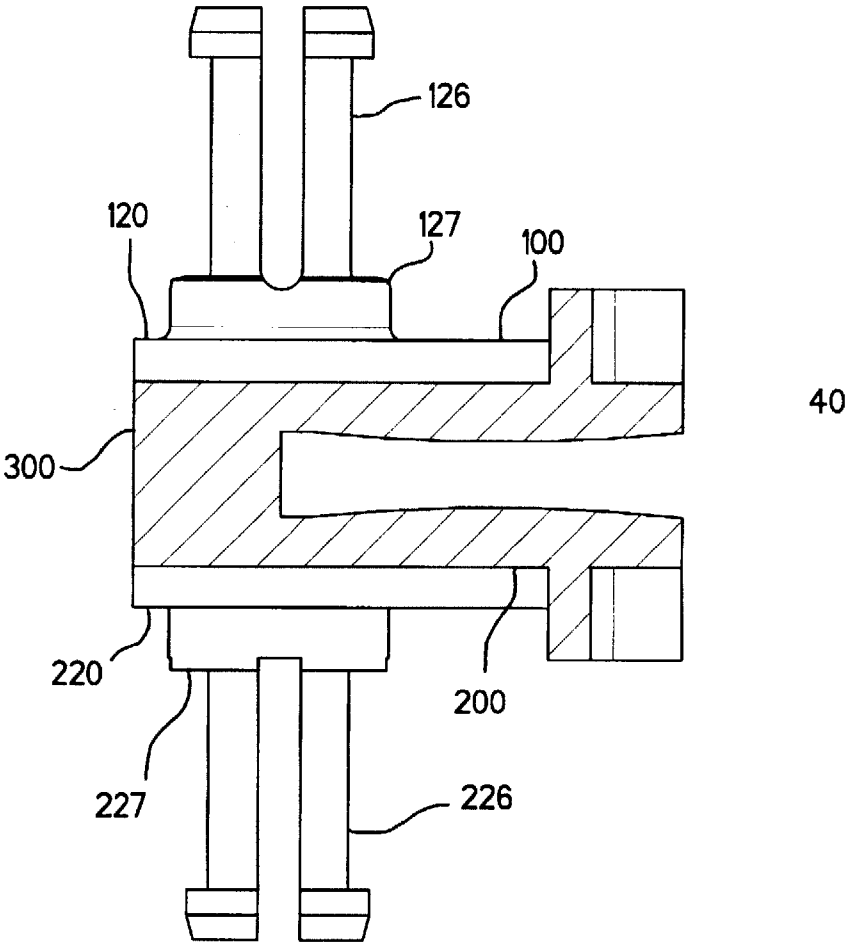
FIG. 7 is an isometric view of a cross section of the straddle adapter of FIG. 5 mounted on a printed circuit board.

FIGS. 6 and 7 illustrate the straddle adapter 10 coupled to a printed circuit board 40. The circuit board 40 is inserted between the first and second plates 100, 200 and fixed thereto by rivets, screws, or other fastener or adhesive at the end regions 120, 140, 220, 240. For example, a rivet or other fastener 20, 30 may be inserted through coaxial holes 121, 221; 141, 241.

The straddle adapter 10 depicted in FIG. 6 includes an alternative design for snap connectors 126, 146, 226, 246, different from that shown in FIGS. 1–5, for example. The straddle adapter 10 also does not include slits 125, 145, 225, 245 between end regions 120, 140, 220, 240 and the central regions 110, 120, or support edges 150, 250.

Figure 8:
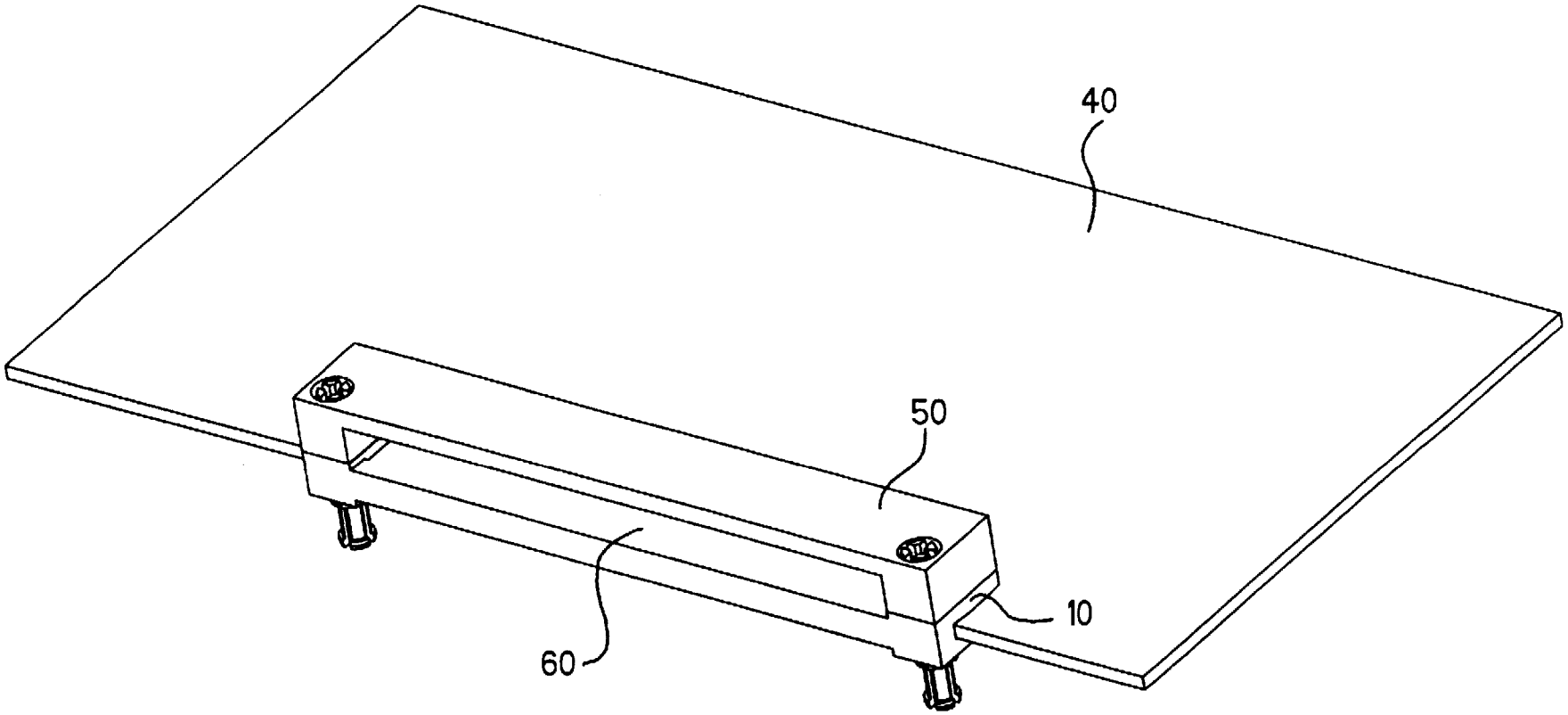
FIG. 8 shows a straddle adapter mounted to a printed circuit board and edge connectors mounted on opposite sides of the straddle adapter.

As shown in FIG. 8, first and second edge connectors 50, 60 are then coupled to the first and second plates 100, 200, respectively, using the snap connectors 126, 146, 226, 246, for example. In one preferred embodiment, the edge connector bodies include a platen, a plurality of pins retained in the platen, and a cover. The platen includes an array of cylindrical buttresses, with each buttress having multiple pins arranged around it. The pins extend through the back of the platen and contact the surface of the circuit board 40. Such an edge connector is discussed in detail in U.S. application Ser. No. [Attorney Docket No. 408979-5071], entitled "Electrical Connector Assembly", filed concurrently herewith, and incorporated herein by reference.

The straddle adapter 10 thus ensures that the edge connectors 50, 60 are separated by a uniform, predetermined distance, despite differences in thickness of the printed circuit board 40.

It will be apparent to those skilled in the art that various modifications and variations can be made in the straddle adapter of the present invention without departing from the scope or spirit of the invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An adapter for coupling a first edge connector and a second edge connector independent of the first edge connector to opposite sides of a circuit board, said adapter comprising:

first and second plates and a side end that joins an edge of said first and second plates so that the first and second plates are spaced apart and substantially parallel to each other, wherein said first and second plates have inner surfaces facing each other and outer surfaces facing away from each other, and the inner surfaces of said first and second plates are adapted to receive an edge of the circuit board therebetween;

first means for mounting the first edge connector to the outer surface of said first plate; and second means for mounting the second edge connector to the outer surface of said second plate.

2. The adapter according to claim 1, wherein each of said first and second plates include a central region and end regions on opposite ends of the central region, and wherein slits are located between the central region and each end region of the first and second plates such that opposing end regions of said first and second plates may be drawn together and the central regions may be maintained substantially parallel to each other.

3. The adapter according to claim 2, wherein the end regions each include on opposing inner surfaces thereof at least one deformable rail adapted to receive opposing sides of the circuit board.

4. The adapter according to claim 3, wherein each deformable rail comprises a swellout on the inner surface of the end regions.

5. The adapter according to claim 2, wherein said first means for mounting comprises first and second snap connectors secured to opposite end regions of said first plate, and said second means for mounting comprises third and fourth snap connectors secured to opposite end regions of said second plate.

6. The adapter according to claim 5, wherein said first and second snap connectors each include a boss for positioning the first edge connector at a predetermined position, and wherein said third and fourth snap connectors each include a boss for positioning the second edge connector at a predetermined position.

7. The adapter according to claim 2, wherein the end regions of said first and second plates each include a hole therethrough for receiving a fastener for attaching the adapter to the circuit board.

8. The adapter according to claim 1, wherein the first and second plates each include at least one side support for supporting back ends of the first and second edge connectors, respectively, when the first and second edge connectors are connected together with corresponding connectors to form an electrical connection.

* * * * *